US008299880B2

(12) United States Patent
Scian et al.

(10) Patent No.: US 8,299,880 B2
(45) Date of Patent: Oct. 30, 2012

(54) TRANSFORMER ASSEMBLY

(75) Inventors: Ilario Scian, Cordenons (IT); Thomas Fogelberg, Ludvika (SE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/080,171

(22) Filed: Apr. 5, 2011

(65) Prior Publication Data

US 2011/0227686 A1 Sep. 22, 2011

Related U.S. Application Data

(63) Continuation of application No. PCT/EP2008/063343, filed on Oct. 6, 2008.

(51) Int. Cl.
*H01F 27/02* (2006.01)
*H01F 27/10* (2006.01)
*H01F 27/04* (2006.01)

(52) U.S. Cl. ..... 336/90; 336/57; 336/58; 336/94; 336/107

(58) Field of Classification Search ..... 336/90, 336/55, 57, 58, 91, 107
See application file for complete search history.

(56) References Cited

U.S. PATENT DOCUMENTS

| | | | | |
|---|---|---|---|---|
| 2,080,226 | A * | 5/1937 | Paxton | 361/620 |
| 2,403,072 | A * | 7/1946 | Gates | 336/5 |
| 2,734,096 | A * | 2/1956 | Ennis | 174/15.1 |
| 3,293,349 | A * | 12/1966 | Diebold et al. | 174/12 R |
| 3,337,680 | A * | 8/1967 | Lear | 174/75 R |
| 3,629,758 | A | 12/1971 | Pearce, Jr. | |
| 3,629,759 | A * | 12/1971 | Douglas et al. | 336/82 |
| 3,697,819 | A * | 10/1972 | Eichelberger et al. | 361/603 |
| 3,701,929 | A | 10/1972 | Taguchi et al. | |
| 3,837,527 | A | 9/1974 | Kutik et al. | |
| 4,085,395 | A * | 4/1978 | Billerbeck et al. | 336/61 |
| 4,581,477 | A * | 4/1986 | Harumoto et al. | 174/15.1 |
| 4,904,972 | A | 2/1990 | Mori et al. | |
| 5,887,439 | A | 3/1999 | Kotliar | |
| 6,804,092 | B1 * | 10/2004 | Magnier | 361/38 |
| 7,317,598 | B2 * | 1/2008 | Magnier | 361/37 |
| 2005/0095177 | A1 | 5/2005 | Golner et al. | |

(Continued)

FOREIGN PATENT DOCUMENTS

EP 0 447 389 A2 9/1991

(Continued)

OTHER PUBLICATIONS

International Search Report (PCT/ISA/210) issued on Dec. 22, 2008, by Japanese Patent Office as the International Searching Authority for International Application No. PCT/EP2008/062569.

(Continued)

*Primary Examiner* — Mohamad Musleh
*Assistant Examiner* — Mangtin Lian
(74) *Attorney, Agent, or Firm* — Buchanan Ingersoll & Rooney PC

(57) ABSTRACT

A transformer assembly is disclosed which includes a housing and an electrical transformer having a tank which is positioned inside the housing. A device for electrically connecting the transformer to an electrical article outside the housing includes a shaped body having a first face which is suitable to be connected to one of the walls of the tank, and a second face which is suitable to be connected to one of the walls of the housing. The shaped body can include a deformable portion which is adapted to adjust the positioning of the second face relative to the wall of the housing to which it is suitable to be connected.

16 Claims, 7 Drawing Sheets

U.S. PATENT DOCUMENTS

2006/0012948 A1 1/2006 Norris et al.

FOREIGN PATENT DOCUMENTS

| | | | |
|---|---|---|---|
| GB | 2 355 857 | A | 5/2001 |
| JP | 56-135911 | A | 10/1981 |
| WO | WO 2008/043389 | A1 | 4/2008 |

OTHER PUBLICATIONS

Written Opinion (PCT/ISA/237) issued on Dec. 22, 2008, by Japanese Patent Office as the International Searching Authority for International Application No. PCT/EP2008/062569.

International Search Report (PCT/ISA/210) issued on Sep. 25, 2009, by Japanese Patent Office as the International Searching Authority for International Application No. PCT/EP2008/062571.

Written Opinion (PCT/ISA/237) issued on Sep. 25, 2009, by Japanese Patent Office as the International Searching Authority for International Application No. PCT/EP2008/062571.

International Search Report (PCT/ISA/210) issued on Jun. 18, 2009, by Japanese Patent Office as the International Searching Authority for International Application No. PCT/EP2008/063343.

Written Opinion (PCT/ISA/237) issued on Jun. 18, 2009, by Japanese Patent Office as the International Searching Authority for International Application No. PCT/EP2008/063343.

* cited by examiner

TRANSFORMER ASSEMBLY

RELATED APPLICATION

This application claims priority as a continuation application under 35 U.S.C. §120 to PCT/EP20086/063343 filed as an International Application on Oct. 6, 2008 designating the U.S., the entire content of which is hereby incorporated by reference in its entirety

FIELD

The present disclosure relates to a transformer assembly for transmitting and/or distributing electrical power.

BACKGROUND INFORMATION

It is known in the art the use of electrical transformers, such as power transformers, for transmitting and distributing electricity through electrical grids.

A task of an electrical transformer is to allow exchanging electric energy between two or more electrical systems of different voltages by stepping up or down the level of voltage.

During their working life electrical transformers may be subject to explosions and fires; these events can be triggered for example by electrical arcs and are fed by the energy flowing from the electrical grid into the transformer.

The effects of such explosions and fires can be very dangerous and may cause severe damages to the transformer and to the various equipment/loads operatively coupled therewith, and disruption of the energy transportation even for long periods, thus resulting in economic losses for utilities/users.

Some solutions have been considered over the years in order to reduce such effects. For example, some electrical transformers have been provided with faster fault detection systems, or with improved protection fuses and circuit breakers. In some other cases explosion valves or sprinkler systems have been used, or different types of non-flammable insulating fluids have been investigated.

It would be desirable to improve the capability of electrical transformers to face and withstand the occurrence of explosions and fires.

SUMMARY

A transformer assembly is disclosed comprising: an electrical transformer having a transformer tank with plural side walls, a top wall, and a base wall; a housing having a base wall, plural side walls, and a top wall, said transformer tank being positioned inside said housing; and a device for electrical connection of said transformer to an electrical article outside said housing, said device having a shaped body with a first face which is suitable to be connected to one of said top, base or side walls of the transformer tank, and a second face which is suitable to be connected to one of said base, top, or side walls of the housing, wherein said shaped body comprises at least one deformable portion for adjusting a positioning of said second face relative to said one of said base, top, or side walls of the housing.

BRIEF DESCRIPTION OF THE DRAWINGS

Features, aspects, and advantages of the present disclosure will become better understood with regard to the following description, appended claims, and accompanying drawings where:

It should be noted that in order to clearly and concisely disclose the exemplary embodiments, the drawings may not necessarily be to scale and certain features of the disclosure may be shown in somewhat schematic form.

DETAILED DESCRIPTION

An exemplary transformer assembly is disclosed and comprises:

an electrical transformer comprising a transformer tank having a plurality of side walls, a top wall, and a base wall;

a housing having a base wall, a plurality of side walls, and a top wall, said transformer tank being positioned inside said housing; and a device for electrically connecting said transformer to an electrical article outside said housing, said connecting device comprising a shaped body having a first face which is suitable to be connected to one of said top, base or side walls of the tank, and a second face which is suitable to be connected to one of said base, top, or side walls of the housing, wherein said shaped body comprises at least one deformable portion which is adapted to adjust the positioning of said second face relative to said one of said base, top, or side walls of the housing, to which it is suitable to be connected to.

Figure 1:
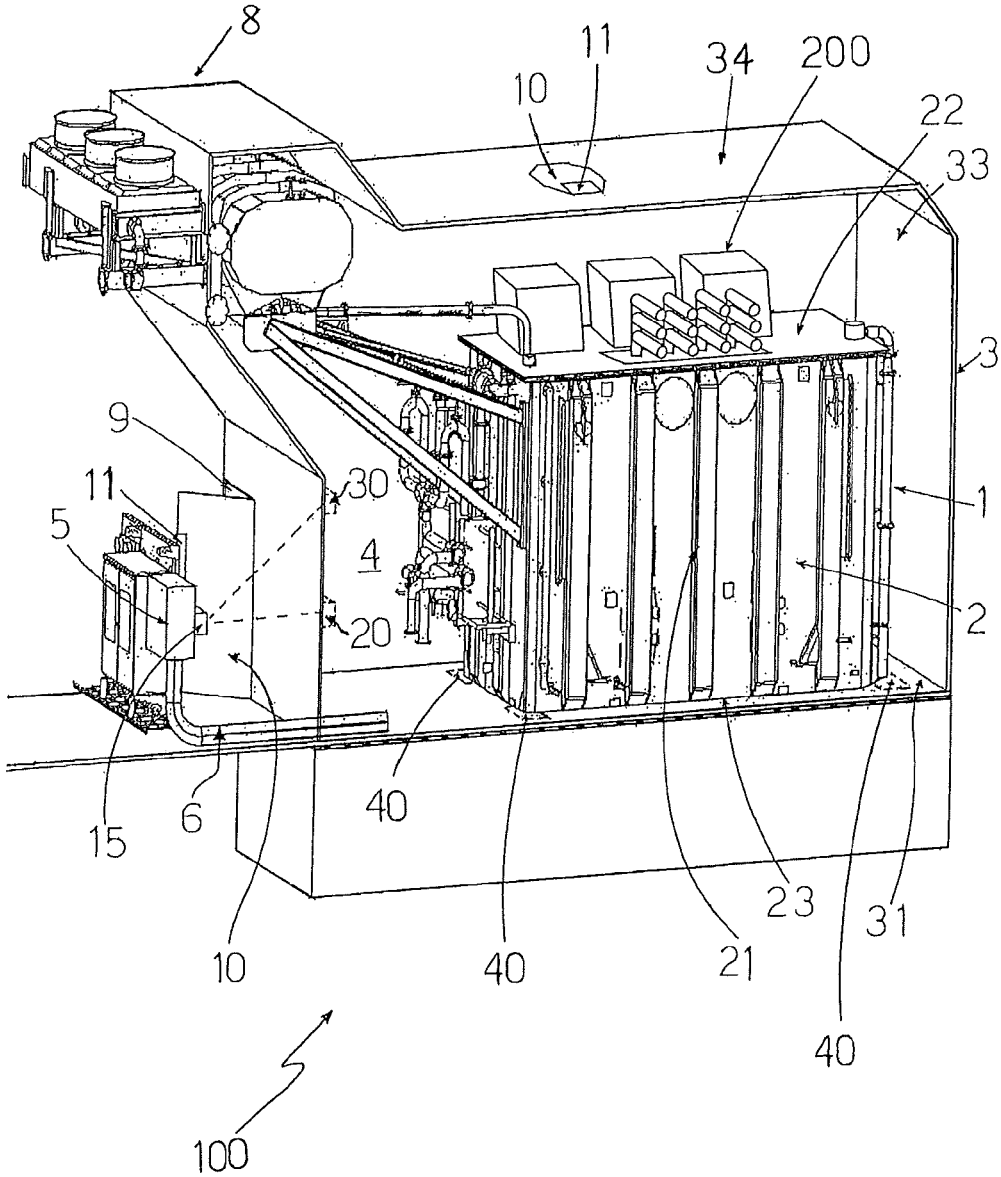
FIG. 1 is a perspective view showing an example of a transformer assembly as disclosed herein.

FIG. 1 is a perspective view (partially cut in order to better illustrate some internal components) of an exemplary transformer assembly according to the disclosure indicated by the overall reference number 100.

As shown, the transformer assembly 100 comprises an electrical transformer 1, such as a power transformer, having a transformer tank 2. The tank 2 comprises a plurality of side walls 21, a top wall 22, a base wall 23, and contains, among the others, the active parts of the transformer (e.g., the core 70 and the windings 7), which are immersed into an insulating fluid (e.g., a mineral oil).

As will be appreciated by those skilled in the art, the transformer 1 can be constituted by any suitable type of transformers available on the market; since the possible overall layouts of the transformer 1, the structure of its various components and their mutual coupling, as well as its functioning, are readily available and known in the art and do not impact an understanding by those skilled in the art of inventive aspects disclosed herein, they will not be described herein in further detail.

The transformer assembly 100 can, for example, include a housing 3 having a base wall 31, a plurality of side walls 33, a top wall 34, inside which the transformer tank 2 is accommodated. In practice, the housing 3 encapsulates the tank 2 with the side walls 33 (or portion thereof) facing the corresponding side walls 21; a free volume or space 4 can be provided between the transformer tank 2 and the housing 3. The volume or space 4 can contain a gaseous atmosphere constituted by a gas or mixture of gases.

For example, when the transformer assembly 100 is initially installed and before conditioning for the scope that will emerge more clearly hereinafter, the gaseous atmosphere can be constituted by ambient air. Alternatively, the space 4 can be filled with any desired and suitable gas of mixtures of gases which may already comprise oxygen or which may not comprise oxygen at all. During the working life of the transformer assembly 100, oxygen can penetrate into the space 4 for any reason, for example when the housing 3 is open for performing maintenance.

For example, inside the housing 3 there can be provided noise dampening means, such as for instance rubber pads or their equivalent; at least some of the noise dampening means, indicated schematically in FIG. 1 by the reference number 40 are, for example, positioned on the base wall 31 of the housing 3, with the tank 2 resting on them.

Suitable cooling means 8 can be provided for properly cooling the transformer 1.

Figure 6:
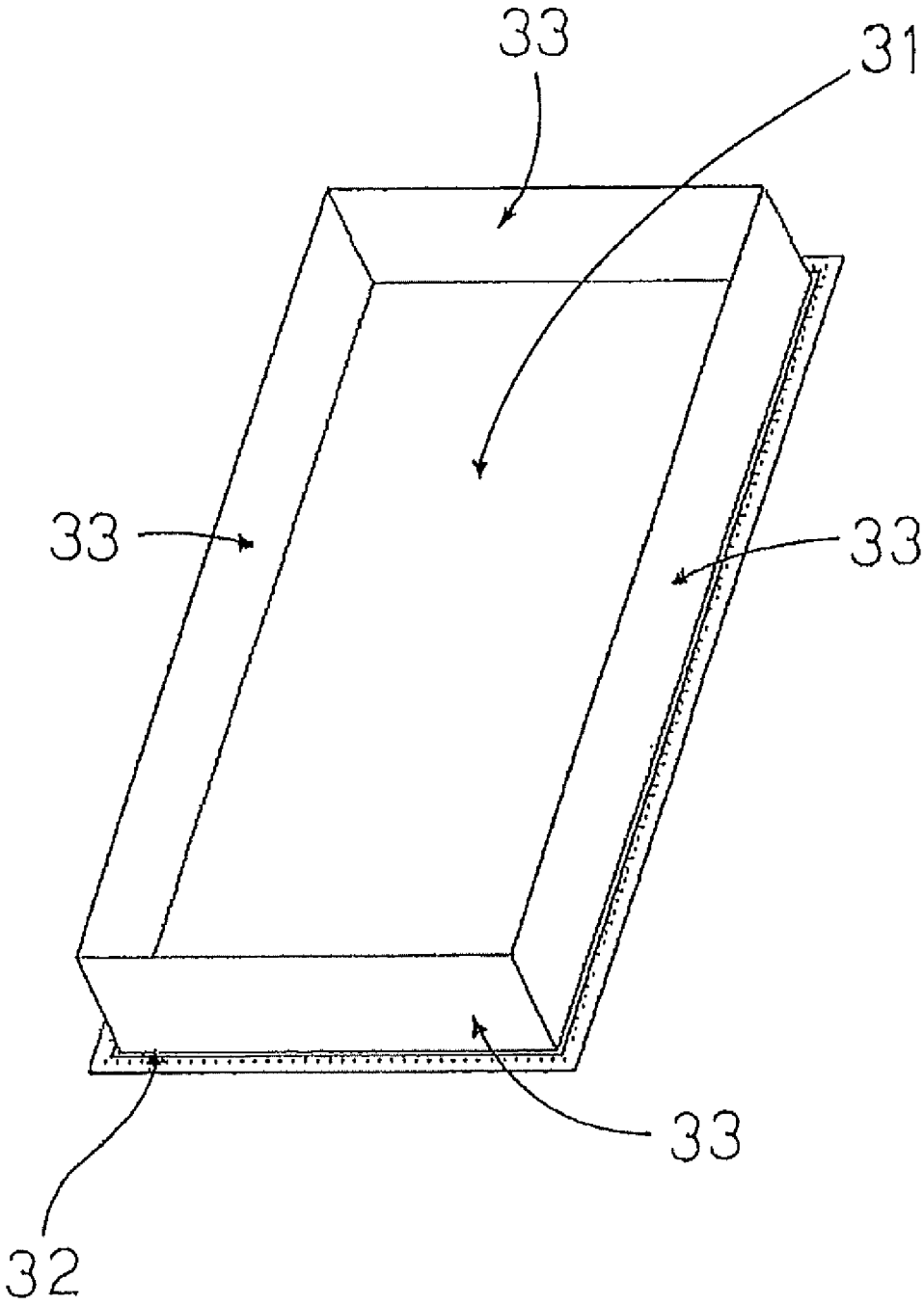
FIG. 6 schematically shows an exemplary partial structure of an external housing usable in the transformer assembly as disclosed herein.

The housing 3 is, for example, structured so as to be substantially airtight. For example, as schematically illustrated in FIG. 6, the housing 3 can be formed by the base wall 31 on which the remaining structure of the housing (e.g., all side walls 33 and the top wall 34) are mounted. The base wall 31 can, for example, be provided with a seat or groove inside which a sealing gasket 32 is placed; then the side walls 33 can be placed into the seat or groove onto the gasket 32. The top wall can be connected to the top part of the side walls 33 for example by soldering or by realizing a structure similar to that of the base wall 31 (e.g., providing the top wall 34 with a corresponding seat or groove inside which another gasket 32 is inserted).

Optionally, the base wall 31 of the housing 3 can form also the base wall 23 of the tank 2.

The housing 3 is, for example, an explosion-proof enclosure (e.g., an enclosure suitable to contain inside the space 4 explosions occurring on the transformer 1).

An exemplary transformer assembly according to the disclosure can comprise a device 200 for electrically connecting the transformer 1 to an electrical article outside the housing 3; this electrical article can be for example a power line or any other piece of electrical equipment/device which is suitable to be electrically connected to the transformer 1.

Figure 7:
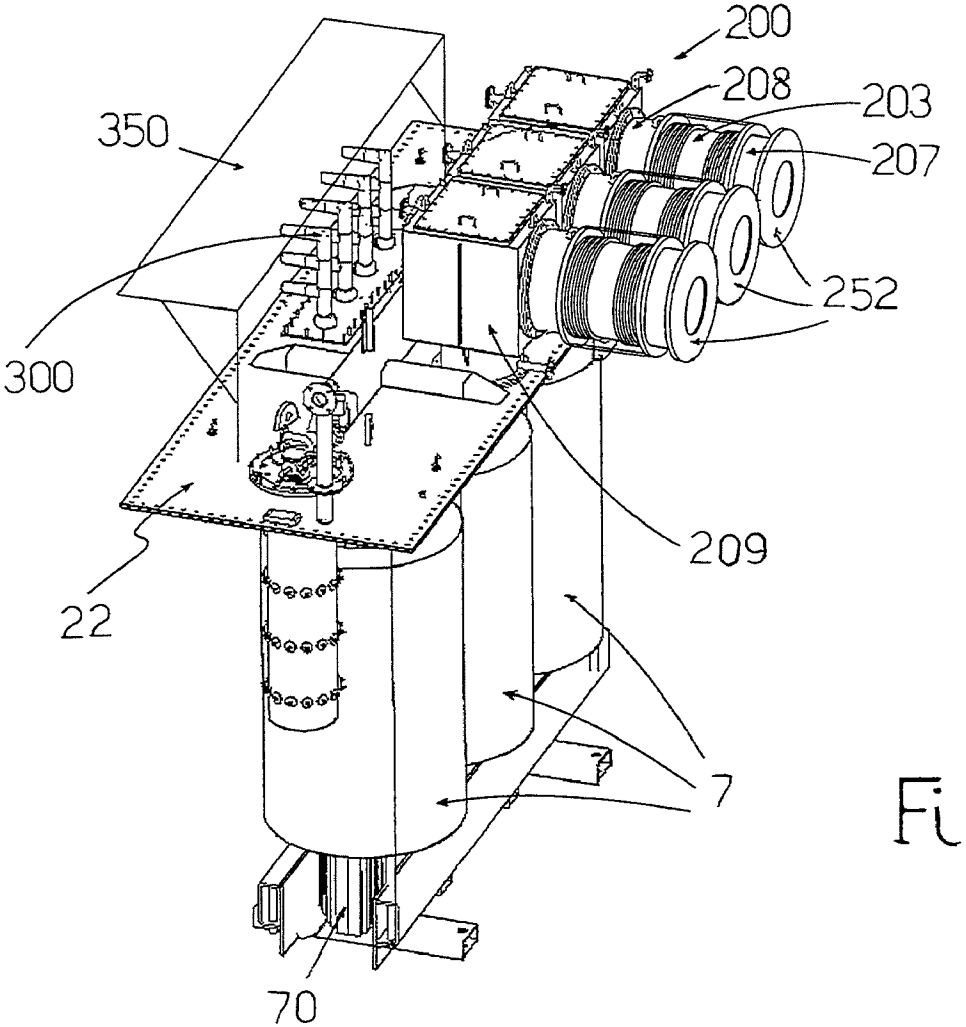
FIG. 7 is a perspective view showing part of an exemplary electrical transformer connected with the connecting device of FIG. 2.

As it is known, an electrical transformer 1 of the type illustrated in the figures, can be provided, for each electrical phase, with two electrical connections, generally indicated as the low-voltage connection and the high-voltage connection, respectively. In an exemplary transformer assembly 100 disclosed herein, for each electrical phase one of the connections (e.g., the low voltage connection) is realized, for example, by means of an insulator 300. As illustrated in FIG. 7, above the series of insulators 300 there can be provided a protective shield 350 which is attached to the top wall 22 of the tank 2; the shield 350 forms a protective barrier in case of explosion of any insulator 300.

The other connection (e.g., the high voltage one), can be realized by means of a connection device 200. For the sake of simplicity, in the following description only one connection device 200 connected to a corresponding phase of the transformer 1 will be described; however, it is evident that each phase of the transformer 1 can be provided with a corresponding connection device 200, as for example illustrated in FIGS. 1 and 7 for the various phases of the transformer 1.

The connecting device 200 comprises a shaped body having a first face 201 which is suitable to be connected to one of the walls of the tank 2, and a second face 202 which is suitable to be connected to one of the walls of the housing 3; further, the shaped body of the device 200 comprises at least one deformable portion 220 which is adapted to adjust the positioning of the second face 202 relative to the wall 31 or 33 or 34 of the housing 3, to which it is suitable to be connected.

The connection between the second face 202 and the wall to which it is connected can be realized in a substantially airtight manner.

Figure 2:
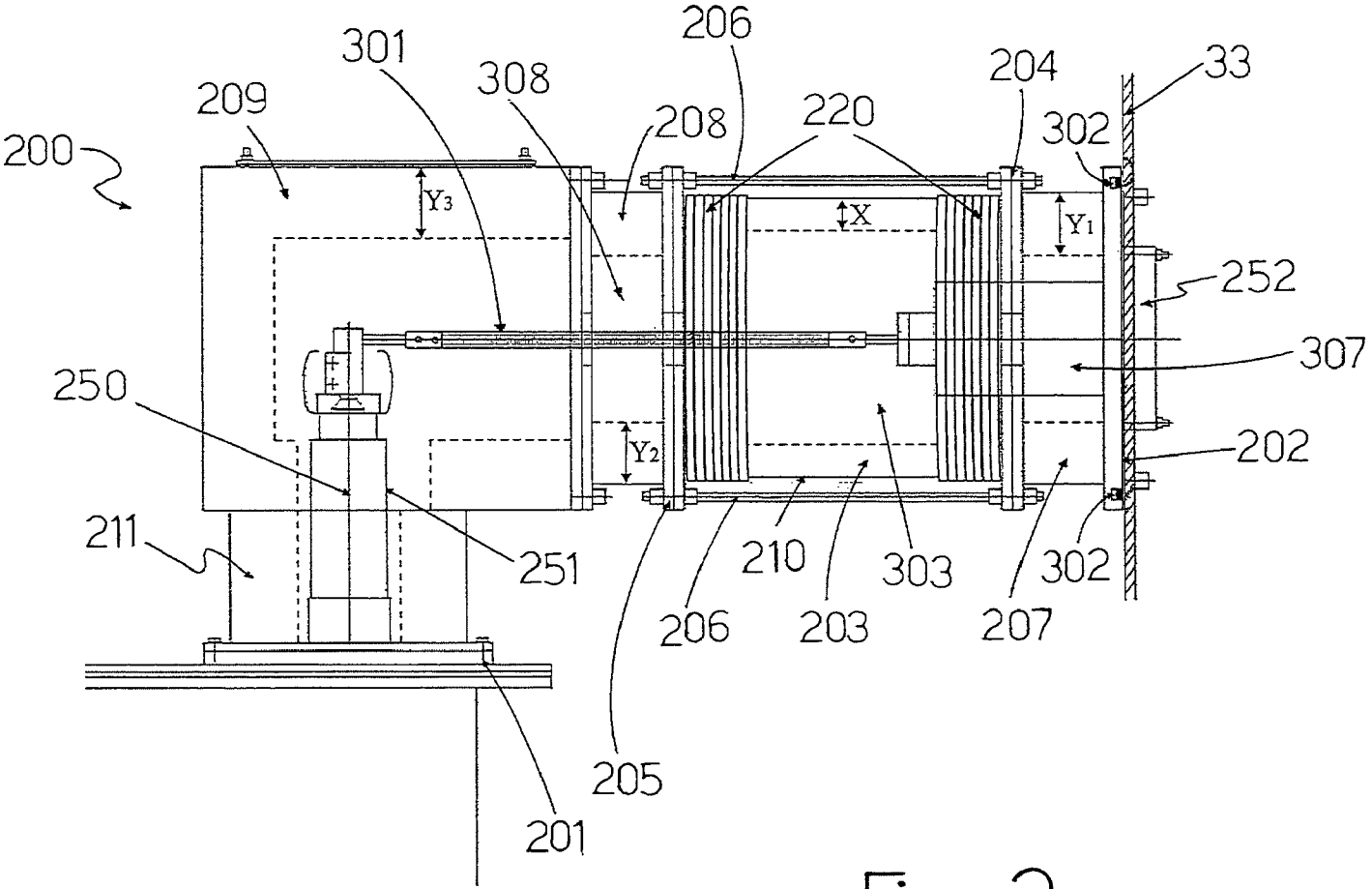
FIG. 2 is a side view schematically showing an exemplary embodiment of a connecting device used in a transformer assembly as disclosed herein.

The shaped body of the connecting device 200 can be positioned entirely inside the space 4 between the housing 3 and the tank 2; for example, as illustrated in FIG. 2, a first end face 201 is preferably connected to the top wall 22 of the tank 2 and a second end face 202 is connected to one of the side walls 33 of the housing 3.

The shaped body of the connection device 200 can be formed by one single piece or, for example, by a plurality of pieces, (e.g., two or more), which are assembled together.

The shaped body of the connecting device 200 can, for example, comprise at least two hollow pieces or components which are mechanically connected to each other with their respective cavities in fluid communication to each other; these cavities define an internal volume which is filled with a dielectric fluid (e.g., a mineral oil) and inside which an electrical conductor 301 is accommodated.

In addition, a first component (hereinafter indicated as the "sacrificial component") of the at least two hollow components constituting the shaped body can be adapted to structurally break before the second component; if the shaped body is formed by more than two pieces, the sacrificial component is, for example, adapted to break before any other structural component of the shaped body itself in case of an explosive event occurring on the connecting device 200.

The sacrificial component can comprise also the at least one deformable portion 220.

For example, the wall surrounding the cavity of the sacrificial component has a thickness (X) which is smaller than the thickness (Y) of the wall surrounding the cavity of the second component; for example, the wall surrounding the cavity of the sacrificial piece has a thickness (X) which is smaller than the thickness (Yi) of the wall surrounding the cavity of any other piece or component forming the shaped body of the connection device 200.

FIG. 2 shows an exemplary embodiment of a connection device 200.

As shown, the first component comprises a hollow cylinder 203, such as a corrugated hollow cylinder 203, made for instance of metal, having at least one corrugated portion forming the deformable portion 220.

In the embodiment illustrated, the shaped body of the device 200 comprises a first flange 204 and a second flange 205 which are connected at the two end faces of the corrugated hollow cylinder 203; further, there are provided one or more tie rods 206 each having a first end connected to the first flange 204 and a second end connected to the second flange 205. The tie rods 206 are positioned around and spaced apart from the outer surface 210 of the corrugated hollow cylinder 203.

The shaped body of the device 200 can comprise a first substantially rigid hollow body 207 and a second substantially rigid hollow body 208 which are connected to the corrugated hollow cylinder 203 at the first flange 204 and at the second flange 205, respectively; the cavities 307, 308 of the hollow cylinders 207, 208 are in fluid communication with the cavity 303 of the corrugated hollow cylinder 203.

As illustrated, the two bodies 207, 208 are, for example, constituted by two substantially structurally rigid hollow cylinders, made for instance of metal.

In the embodiment illustrated, the first hollow cylinder 207 is attached to a side wall 33 of the housing 3; hence, in this case the second face 202 is formed by the end face of the cylinder 207. As shown in FIG. 2, the end face 202 of the cylinder 207 is provided with a groove or seat inside which a gasket 302 (e.g., an o-ring gasket), is inserted in order to realize a substantially airtight connection with the side wall 33.

For example, at least the wall surrounding the cavity of the component attached to a wall of the housing 3, in this embodiment the wall surrounding the cavity 307 of the first hollow cylinder 207, has a thickness (Y1) which is greater than the thickness (X) of the wall surrounding the cavity 303 of the corrugated hollow cylinder 203.

In the exemplary embodiment illustrated, also the wall surrounding the cavity 308 of the second hollow cylinder 208 has, for example, a thickness (Y2) which is greater than the thickness (X) of the wall surrounding the cavity 303 of the corrugated hollow cylinder 203.

In the exemplary embodiment illustrated, the shaped body of the device 200 comprises a substantially structurally rigid hollow element 209 (e.g., made of metal), which can be constituted by one single piece or by two connected pieces (e.g., a main box-shaped part can be attached to a hollow cylindrical piece 211).

The hollow element 209 is connected to the second hollow cylinder 208 and to the top wall 22 of the tank 2, respectively; therefore, in this case the first face 201 is formed by an end face of the element 209.

The cavity 309 of the hollow element 209 is also in fluid communication with the cavity 308; the thickness (Y3) of the wall surrounding the cavity 309 is, for example, greater than the thickness (X) of the wall surrounding the cavity 303 of the corrugated hollow cylinder 203.

Hence, the hollow cylinder 203 comprises the deformable portion (e.g., the corrugated part), and has the smallest thickness (X) thus constituting at the same time also the piece of the shaped body adapted to structurally break before any other component of the shaped body itself (e.g., in this embodiment the components or pieces 207, 208, 209).

Optionally, it is possible to size one side wall of the element 209 with a thickness suitably reduced with respect to the other walls of the element 209 so that said one side wall acts as a sacrificial element in case of explosions occurring at or close to the element 209 itself.

In practice, when attaching the assembled device 200 to the wall of the housing 3, a user can act on the one or more tie rods 206 thus causing a deformation of the corrugated portion 203, which in turn modifies the orientation of the end face 202 with respect to the attaching wall of the housing 3; in this way, by appropriately acting on the tie rods 206, it is possible to adjust the mutual positioning of the end face 202 relative to the attaching wall of the housing 3 thus easing their connection and realizing a more precise alignment and connection.

When the device 200 is connected, the various cavities above described (e.g., the cavities 303, 307, 308, 309) form an internal volume which is filled with an electrically insulating fluid (e.g., a mineral oil), and houses the electrical conductor 301 which can be formed by one or more pieces. The conductor 301 is connected on one side to a conductor piece 250 running through an insulator 251 towards the inside of the tank 2; a plug connector 252 is inserted from the outside of the housing 3 into the hollow cylinder 207 and is connected to the other side of the conductor 301. This plug connector 252 is suitable to be connected to the mentioned electrical article.

Figure 3:
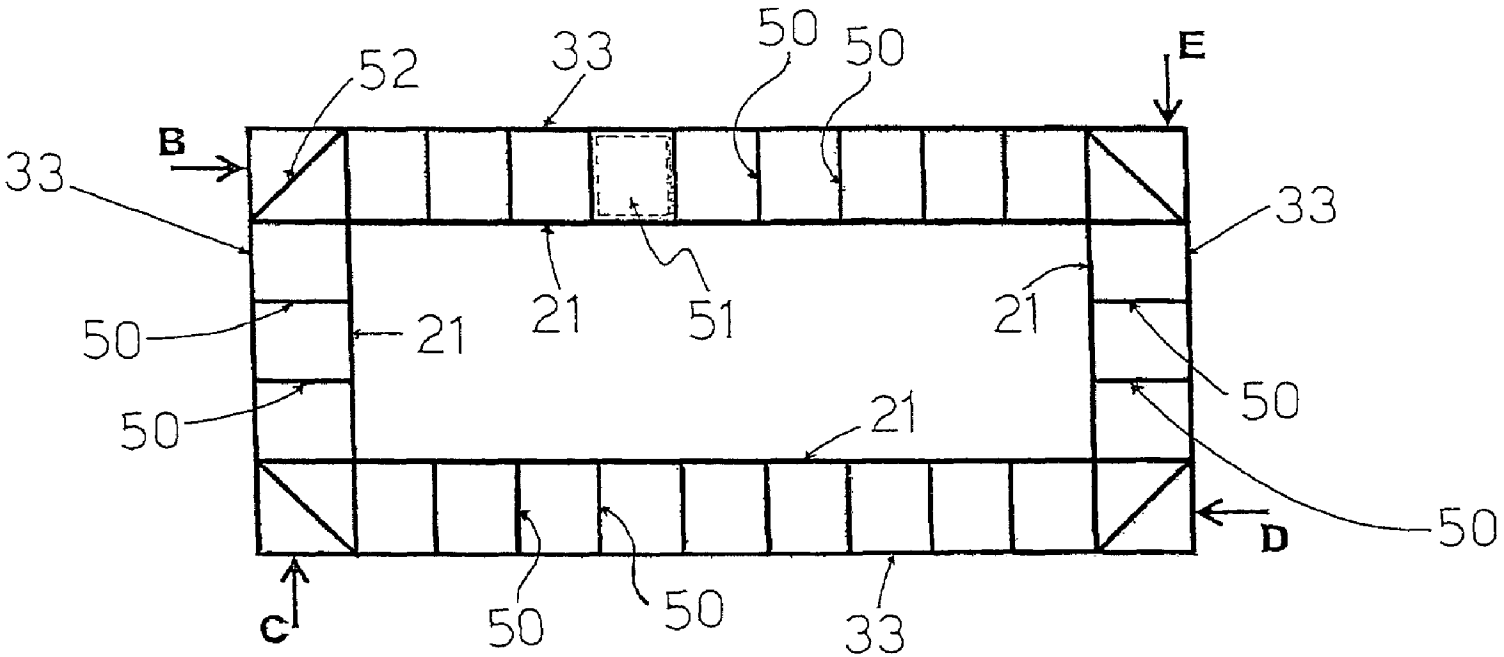
FIG. 3 is a plan view schematically showing an exemplary structure of the transformer tank associated to an external housing.
Figure 4:
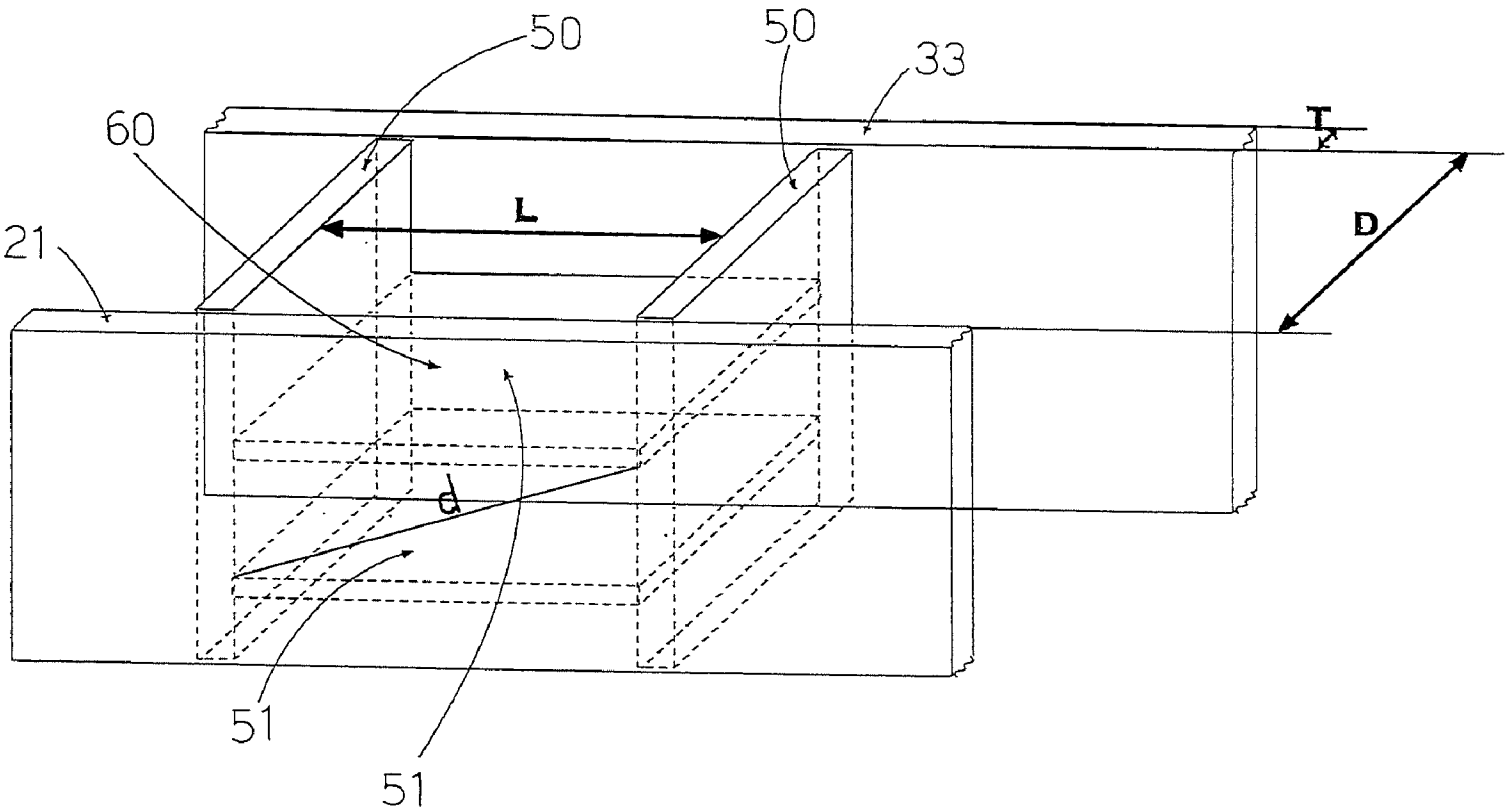
FIG. 4 is a perspective view showing an exemplary embodiment of part of the transformer assembly as disclosed herein.

According to a exemplary embodiment schematically illustrated in FIGS. 3-4, the housing 3 comprises at least one side wall 33, and, for example, the side wall 33 to which the second face 202 is connected to, which has a minimum thickness (T) and is positioned at a minimum distance (D) from the corresponding side wall 21 facing it, wherein the ratio between its minimum thickness (T) and its minimum distance (D) from the corresponding facing wall 21 is, for example, between 0.0001 and 100. For example, if the minimum distance (D) is 10 m, the minimum thickness of the subject side wall 33 is 1 mm.

According to the applications, each side wall 33 (as well as the top and base walls) of the housing 3 may have a constant or variable thickness (T), and two or more side walls may have substantially the same thickness (T) or a thickness different from each other; further, each side wall 33 of the housing 3 can be positioned at the same distance (D) from a corresponding facing side wall 21 of the tank 2, as for instance illustrated in FIG. 3, or can be placed at different distances (D).

In any case, according to an exemplary embodiment, each side wall 33 of the housing 3 has a minimum thickness ($T_1$, $T_2$, . . . $T_n$) and is positioned at a minimum distance ($D_1$, $D_2$, . . . $D_n$) from the corresponding facing wall 21 of the tank 2, so that each ratio ($T_1/D_1$, $T_2/D_2$, . . . Tn/Dn) between the thickness ($T_i$) of a side wall 33 of the housing 3 and its distance ($D_i$) from the corresponding facing wall 21 of the tank 2 is, for example, between 0.0001 and 100.

According to a possible exemplary embodiment schematically illustrated in FIGS. 3-4, the transformer assembly comprises a plurality of reinforcing walls 50. Each reinforcing wall 50 is positioned between a side wall 33 of the housing 3 and the corresponding facing side wall 21 of the tank 2.

The reinforcing walls 50 can have, for example, a rectilinear profile and can be positioned parallel to each other along a side of the transformer assembly (sides indicated by capital letter B, C, D, E in FIG. 3).

In any case, according to a exemplary embodiment, two adjacent reinforcing walls 50 which are positioned along the same side (B, or C, or D, or E) of the transformer assembly 100, are spaced apart from each other of a minimum distance (L); this distance (L) is, for example, shorter than the minimum distance (D) between the side wall 33 and the corresponding facing wall 21 between which the couple of adjacent reinforcing walls 50 is positioned.

Further, as schematically illustrated in FIG. 4, in each volume or area 60 delimited by two adjacent reinforcing walls 50, by the associated side wall 33 and the respective facing wall 21, there can be positioned one or more transversal reinforcing walls 51. The transversal reinforcing walls 51 are positioned spaced apart from each other along the vertical extension of the surrounding walls 21, 33, 50 and can be connected to one or more of them.

As illustrated in FIG. 4, the diagonal distance (d) between two corners (positioned on a same plane parallel to the side wall 33 or the facing side wall 21) formed by two adjacent walls 51 and the two corresponding adjacent walls 50 is shorter than said distance (D).

If desired, some additional reinforcing walls 52 can be positioned diagonally at the corners of the transformer assembly 100 as schematically illustrated in FIG. 3.

The transformer assembly 100 can further comprise conditioning means adapted to regulate the level or content of oxygen of the gaseous atmosphere inside the space 4.

For example, the conditioning means can be configured so as to maintain the level of oxygen of the atmosphere inside the space 4 below or equal to a first predefined threshold at a first status of the electrical transformer 1 (e.g., under normal working conditions), and equal to or above a second predefined threshold at a second status of the electrical transformer 1 (for example, in order to allow personnel to enter inside the housing 3 and perform maintenance).

The first threshold and the second threshold of oxygen level can be selected according to, for example, applications and/or standards defined internationally or at country levels. Such first and second thresholds can even coincide but they are, for example, different from each other; for example, in the transformer assembly according to the disclosure the first threshold is about 16% (or even lower) of oxygen content of the total volume of gaseous atmosphere inside the space 4, while the second threshold of oxygen content is about 17% of the total volume of gaseous atmosphere inside the space 4 (where "about" is ±10%).

The conditioning means can comprise a device adapted to introduce into the space 4 a gas or mixtures of gases comprising a predetermined quantity of oxygen; according to the scope and purpose disclosed herein, the predetermined quantity of oxygen can be also equal to zero.

According to a first exemplary embodiment, the conditioning means can comprise a first device adapted to introduce into the space 4 a gas or mixtures of gases comprising a quantity of oxygen lower than that of ambient air (even equal to zero), and a second device adapted to introduce into the space 4 a gas or mixtures of gases having a quantity of oxygen equal to or higher than that of ambient air. Reference is hereby made to the average composition of ambient air at sea level.

Alternatively, the conditioning means can comprise a unique device configured to introduce into the space 4 a gas or mixtures of gases having a quantity of oxygen lower than that of ambient air at the first status, or a gas or mixtures of gases having a quantity of oxygen equal to or higher than that of ambient air at the second status.

The conditioning device/devices can be constituted by one or more suitable storage units containing a mixture of gases or a substantially pure gas, with a predetermined content of oxygen. For example, it is possible to use a cylinder or bottle (optionally associated to a compressor) which contains nitrogen and is properly coupled to the housing 3 in order to introduce into the space 4 the needed quantity of gas contained therein thus bringing the level of oxygen inside the space 4 equal to or below the first threshold.

The same applies when using for example one or more storage units containing only oxygen or a mixture of gases with a content of oxygen higher than that of ambient air.

The conditioning means can, for example, comprise also a sensor for detecting/monitoring oxygen inside the space 4, schematically indicated in FIG. 1 by the reference number 20. A control unit 15, which is embedded into or coupled to the above indicated device/devices, based on the information received from the oxygen sensor, checks if the level of oxygen in the space 4 is compatible with the actual status of the transformer. If this is not the case, the control unit 15 triggers an increase or reduction of the level of oxygen inside the space 4 by causing intervention of the above indicated device/devices.

As it will be appreciated by those skilled in the art, the construction and functioning of the control unit 15 can be readily and easily configured without inventive activity beyond that which is disclosed herein, and therefore will not be described herein in detail.

The conditioning means can comprise also a pressure sensor, schematically indicated in FIG. 1 by the reference number 30 which is also operatively coupled to the control unit 15. Signals from the pressure sensor 30 are received by the control unit 15 thus allowing to measure and monitor the pressure of the gaseous atmosphere contained inside the space 4. If such a pressure is above or below a predefined selectable threshold, the control unit 15 stops or activates the above indicated conditioning device/devices.

Figure 5:
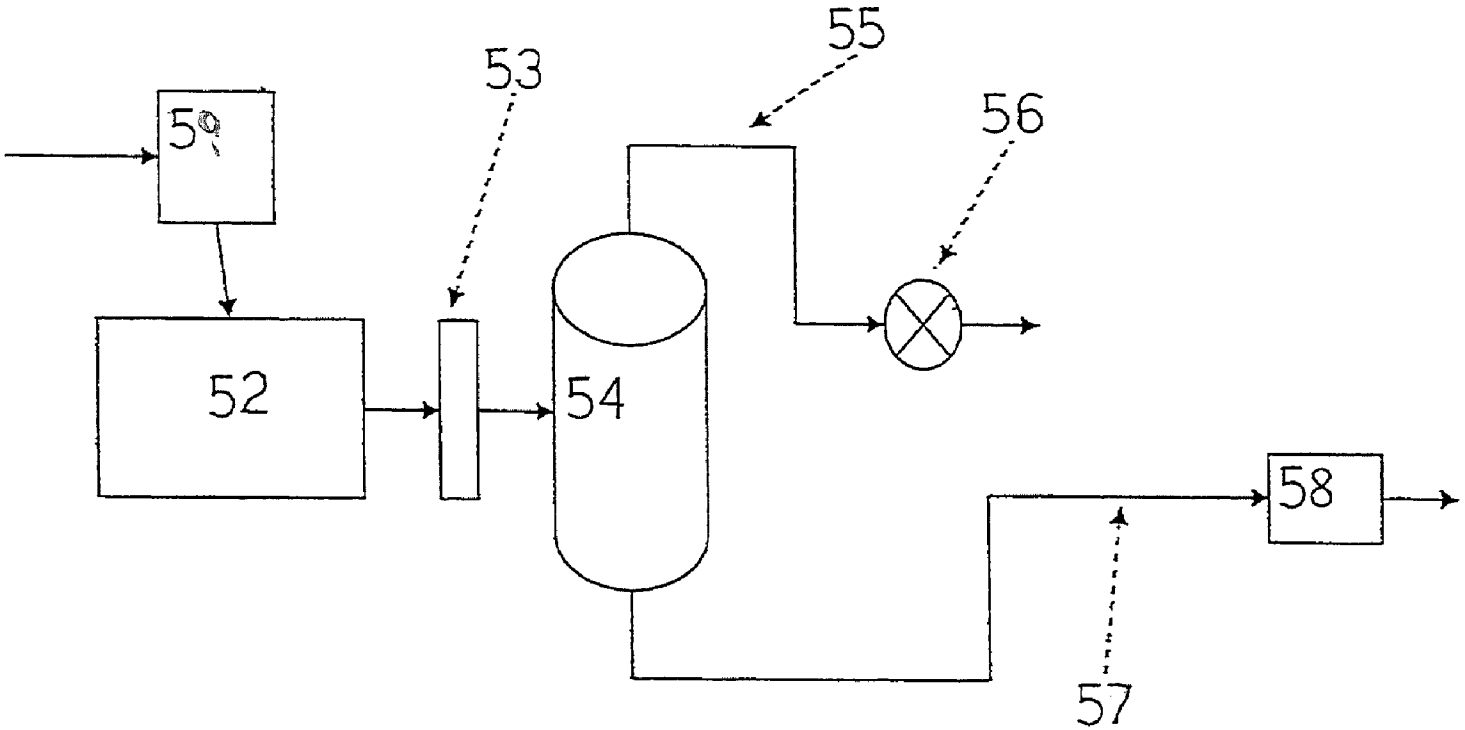
FIG. 5 is a block diagram schematically illustrating an exemplary embodiment of conditioning means usable in the transformer assembly as disclosed herein.

FIGS. 1 and 5 schematically illustrate an exemplary embodiment for the conditioning means. According to this embodiment, the conditioning means comprises a generator 5 of a gas or mixtures of gases comprising a level of oxygen lower than that of ambient air (e.g., a nitrogen or hypoxic-air or depleted-oxygen-air generator).

The generator 5 can be attached directly onto one of the walls of the housing 3 or positioned at a certain distance there from. Conduits 6 or equivalent means can be used for circulating the gas or mixture of gases generated inside the space 4.

As shown in the exemplary schematic block diagram of FIG. 5, the generator 5 can comprise an inlet 59 sucking ambient air and provided with a dust filter in order to clean up the sucked quantity of air. The airflow is then compressed by a compressor 52 and passes through a cooler 53 which cools the hot compressed air coming out from the compressor 52. The air is then treated inside a module 54 adapted to separate gases. In practice, the module 54 allows separating gases composing the air under treatment, and, for example, to separate oxygen from the other gases, such as nitrogen.

The module 54 can comprise, for example, a chamber with an assembly of valves and molecular sieve beds for separating gases, and, for example, absorbing oxygen (PSA—Pressure Swing Absorption-module). Alternatively, a chamber with suitable membranes can be used.

Therefore, in output from the module 54 there is a first flow 55 of oxygen enriched air and a second flow 57 of hypoxic air (or in equivalent terms hyper nitrogen air). When desired, the second flow 57 is introduced into the space 4 by means of the conduits 6, directly or after passing through an optional filter 58 (e.g., a high efficiency particulate air filter) for further cleaning up the hypoxic air.

In turn, the first flow 55 of oxygen enriched air can be relaxed into the ambient air directly or after passing an optional adjustable or fixed flow regulator 56.

Examples of suitable devices of the type above described are those marketed by Rich International Trade Co. Ltd under the model name BGPN, or by Parke Hannifin Corporation under the product name Nitroflow.

According to this exemplary embodiment, the conditioning means adapted to introduce into the space 4 a gas or mixtures of gases having a quantity of oxygen equal to or higher than that of ambient air can comprise at least one opening 9 located on the housing 3 which is provided with a panel 10. The panel 10 is moveable between a first closed position at the first status of the electrical transformer 1 and a second open position at the second status of the electrical transformer 1.

For example, as schematically shown in FIG. 1, the panel 10 can be constituted by an airtight door 10 suitable to close an opening 9 devised to allow access of personnel inside the housing 3.

Alternatively or in addition to the door 10, the moveable panel can be constituted by an airtight manhole 10 which is associated to an opening 9 positioned on one of the walls of the housing 3 (e.g., on the top wall 34).

The moveable panel 10, be it the airtight door and/or the airtight manhole, can be provided with a protection device 11, such as a simple mechanical interlock, for preventing people accessing the space 4 at least until the level of oxygen inside the space 4 is below the second threshold, and, for example, until the atmosphere inside the space 4 has reached a minimum human breathable level.

If desired, the above described generator 5 can be used, alternatively or in addition to the opening(s) 9-panel(s) 10, to introduce into the space 4 a gas or mixtures of gases having a quantity of oxygen higher than that of ambient air. In this case it would be possible to introduce into the space 4 the first flow 55 of enriched oxygen air (e.g., through the conduits 6).

In practice, it has been found that an exemplary transformer assembly according to the disclosure can provide advantages and improvements with respect to known solutions. In fact, the connection device 200 can allow an easy, precise, and safe connection between each phase of the transformer 1 and electrical parts positioned outside the housing 3. If under normal working conditions, there is an explosive event occurring into any of the devices 200, the rupture of one of the pieces of its body (e.g., the hollow cylinder 203) allows discharging the effects of such explosion into the housing 3. Also when an explosion occurs within the transformer 1, the housing 3 can contain such an explosion due to the above described structure. In addition, the gaseous atmosphere inside the space 4 can be monitored and regulated so that the content of oxygen is below or equal to the first threshold thus resulting in a substantially fire-inert gas atmosphere (e.g., an atmosphere suitable to prevent ignition of fires, or at least to fast suppress their propagation). When it is desired for personnel to enter the space 4 inside the housing 3, the conditioning means previously described can allow increasing of the level of oxygen up to or above the second indicated threshold, thereby creating a breathable environment inside the housing 3.

The exemplary transformer assembly thus described can be modified to include any numerous modifications and variations, all of which are within the scope of the inventive concepts disclosed herein. For example, the connection device 200 can be constituted by any number of components or pieces, wherein each of the components may be realized in any suitable material and can have any suitable shape. All details disclosed herein may furthermore be replaced with other technically equivalent elements, and the materials and dimensions may be according to any desired specifications and to the state of the art, provided they are compatible with the scope of and functioning in the subject application.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A transformer assembly comprising:

an electrical transformer having a transformer tank with plural side walls, a top wall, and a base wall;

a housing having a base wall, plural side walls, and a top wall, said transformer tank being positioned inside said housing;

a device for electrical connection of said transformer to an electrical article outside said housing, said device having a shaped body with a first face for connection to one of said top, base or side walls of the transformer tank, and a second face for connection to one of said base, top, or side walls of the housing, wherein said shaped body comprises at least one deformable portion for adjusting a positioning of said second face relative to said one of said base, top, or side walls of the housing;

wherein the shaped body of the device comprises:

at least two hollow components which are mechanically connected to each other with respective cavities in fluid communication, said cavities defining an internal volume which for filling with a dielectric fluid and inside which an electrical conductor is accommodated; and wherein a first component of said at least two hollow components is adapted to structurally break before a second component of said at least two hollow components.

2. The transformer assembly according to claim 1, wherein said shaped body is positioned entirely inside a space between said housing and said transformer tank, with said first face connected to the top wall of the transformer tank and said second face connected to one of the side walls of the housing.

3. The transformer assembly according to claim 1, wherein a connection between said second face and said base, top, or side walls of the housing is substantially airtight.

4. The transformer assembly according to claim 1, wherein said first component adapted to structurally break before said second component comprises said at least one deformable portion.

5. The transformer assembly according to claim 1, wherein said first component comprises:

a hollow cylinder having at least one corrugated portion forming said deformable portion.

6. The transformer assembly according to claim 5, wherein said shaped body comprises:

a first flange and a second flange which are connected at two end portions of said corrugated portion of said hollow cylinder; and at least one tie rod having a first end connected to said first flange and a second end connected to said second flange, said tie rod being positioned around and spaced apart from an outer surface of said hollow cylinder.

7. The transformer assembly according to claim 6, wherein said shaped body comprises:

a first hollow body and a second hollow body which are connected to said corrugated portion of said hollow cylinder at said first and second flanges with respective cavities in fluid communication.

8. The transformer assembly according to claim 7, wherein at least said first hollow body has a wall thickness which is greater than a thickness of a wall surrounding a cavity of said corrugated portion of the hollow cylinder.

9. The transformer assembly according to claim 7, wherein said shaped body comprises:

a hollow element which is connected to said second hollow body and said top wall of the tank, respectively, a cavity of said hollow element being in fluid communication with a cavity of said second hollow body to define the internal volume filled with a dielectric fluid.

10. The transformer assembly according to claim 1, wherein said one of said side walls of the housing to which said second face is connected has a minimum thickness and is positioned at a minimum distance from a corresponding facing side wall of the transformer tank, wherein a ratio between said minimum thickness and said minimum distance is between 0.0001 and 100.

11. The transformer assembly according to claim 10, wherein each side wall of said plural side walls of said housing has a respective minimum thickness and is positioned at a minimum distance from a corresponding facing wall of said transformer tank, wherein each ratio between a thickness of a side wall of said housing and its minimum distance from a corresponding facing wall of the transformer tank is between 0.0001 and 100.

12. The transformer assembly according to claim 1, comprising:

plural reinforcing walls, each of said reinforcing walls being positioned between a side wall of the housing and a corresponding facing side wall of the transformer tank.

13. The transformer assembly according to claim 12, wherein two adjacent reinforcing walls are spaced apart from each other by a minimum distance which is shorter than the minimum distance between the side wall of the housing and the corresponding facing side wall of the transformer tank between which said two adjacent reinforcing walls are positioned.

14. The transformer assembly according to claim 12, comprising:

plural transverse reinforcing walls, each of which is positioned in a space delimited by a side wall of the housing, a corresponding facing side wall of the tank and two adjacent reinforcing walls positioned there between, a diagonal distance between two corners formed by two adjacent transverse walls and two corresponding adjacent reinforcing walls being shorter than said minimum distance between the side wall of the housing and the corresponding facing side wall of the tank between which said two adjacent transverse walls and said two adjacent reinforcing walls are positioned.

15. The transformer assembly according to claim 1, wherein said housing is substantially airtight.

16. The transformer assembly according to claim 1, wherein said housing is an explosion-proof enclosure.

* * * * *